US009252501B2

(12) United States Patent
Franzon et al.

(10) Patent No.: US 9,252,501 B2
(45) Date of Patent: Feb. 2, 2016

(54) MILLIMETER SCALE THREE-DIMENSIONAL ANTENNA STRUCTURES AND METHODS FOR FABRICATING SAME

(75) Inventors: Paul D. Franzon, New Hill, NC (US); Peter Gadfort, Raleigh, NC (US); Wallace Shepherd Pitts, Raleigh, NC (US)

(73) Assignee: North Carolina State University, Raleigh, NC (US)

( * ) Notice: Subject to any disclaimer, the term of this patent is extended or adjusted under 35 U.S.C. 154(b) by 438 days.

(21) Appl. No.: 13/481,928

(22) Filed: May 28, 2012

(65) Prior Publication Data

US 2013/0314291 A1 Nov. 28, 2013

(51) Int. Cl.

| | |
|---|---|
| ***H01Q 21/20*** | (2006.01) |
| ***H01Q 1/38*** | (2006.01) |
| ***H01Q 7/00*** | (2006.01) |
| ***H01Q 21/24*** | (2006.01) |

(52) U.S. Cl.

CPC ..... *H01Q 21/205* (2013.01); *H01Q 1/38* (2013.01); *H01Q 7/00* (2013.01); *H01Q 21/24* (2013.01); *Y10T 29/49016* (2015.01)

(58) Field of Classification Search

CPC ..... H01Q 1/36; H01Q 1/38; H01Q 7/00; H01Q 21/205; H01Q 21/24

USPC ..... 343/741, 866, 870, 895

See application file for complete search history.

(56) References Cited

U.S. PATENT DOCUMENTS

| | | | | |
|---|---|---|---|---|
| 5,786,792 | A * | 7/1998 | Bellus et al. | 343/770 |
| 5,898,413 | A | 4/1999 | Mandai et al. | |
| 6,069,564 | A | 5/2000 | Hatano et al. | |
| 6,359,596 | B1 * | 3/2002 | Claiborne | 343/795 |
| 6,765,537 | B1 * | 7/2004 | Apostolos | 343/741 |
| 7,046,209 | B1 * | 5/2006 | McCarville et al. | 343/797 |
| 7,760,144 | B2 * | 7/2010 | Chang et al. | 343/700 MS |
| 8,077,112 | B2 | 12/2011 | Welsh | |
| 2009/0182426 | A1 * | 7/2009 | Von Arx et al. | 623/11.11 |

OTHER PUBLICATIONS

Tentzeris, "Novel Paper-Based Inkjet-Printed Antennas and Wireless Sensor Modules," COMCAS 2008, pp. 1-8 (2008).

Glaser et al., "A Low Cost, High Performance Three-Dimensional Memory Module Technology," IEEE, pp. 1-6 (Jun. 6, 1997).

* cited by examiner

*Primary Examiner* — Robert Karacsony
*Assistant Examiner* — Daniel J Munoz
(74) *Attorney, Agent, or Firm* — Jenkins, Wilson, Taylor & Hunt, P.A.

(57) ABSTRACT

Millimeter scale three dimensional antenna structures and methods for fabricating such structures are disclosed. According to one method, a first substantially planar die having a first antenna structure is placed on a first surface. A second substantially planar die having at least one conductive element is placed on a second surface that forms an oblique angle with the first surface. The first and second dies are mechanically coupled to each other such that the first die and the first antenna structure extend at the oblique angle to the second die.

14 Claims, 16 Drawing Sheets

MILLIMETER SCALE THREE-DIMENSIONAL ANTENNA STRUCTURES AND METHODS FOR FABRICATING SAME

GOVERNMENT INTEREST

This invention was made with government funds under Contract No. HR0011-10-3-0002 awarded by DARPA. The U.S. government has rights in this invention.

TECHNICAL FIELD

The subject matter described herein relates to antenna structures. More particularly, the subject matter described herein relates to methods for fabricating millimeter scale 3D antenna structures and structures made using such methods.

BACKGROUND

In applications, such as biological sensor implants and mobile communications devices, it is desirable to have antennas that work equally well in all directions, regardless of the orientation of the antenna. For some applications, millimeter scale antenna structures suitable for use at frequencies of 2.4 GHz, 5 GHz, and 60 GHz are desirable. Planar antennas of millimeter scale can be formed on a substrate. However, to achieve orientation-independent omnidirectionality, three dimensional antenna structures are desirable. Another reason that three dimensional antenna structures are desirable is to reduce the effects of interference from integrated circuits located on a substrate near an antenna structure.

One possible method of fabricating millimeter scale three dimensional antennas is to form the antennas on a flexible planar substrate and then bend the substrate to form a three dimensional antenna structure. One problem with this approach is that flexible substrates have a minimum bending radius of much larger than one millimeter and can thus not easily be used to form three dimensional antenna structures.

Accordingly, there exists a need for methods for forming millimeter scale three dimensional antenna structures and antenna structures formed using such methods.

SUMMARY

Millimeter scale three dimensional antenna structures and methods for fabricating such structures are disclosed. According to one method, a first substantially planar die having a first antenna structure is placed on a first surface. A second substantially planar die having at least one conductive element is placed on a second surface that forms an oblique angle with the first surface. The first and second dies are mechanically coupled to each other such that the first die and the first antenna structure extend at the oblique angle to the second die.

According to another aspect of the subject matter described herein, a three dimensional antenna structure is provided. The three dimensional antenna structure includes a substantially planar rigid base die of millimeter dimensions and having at least one conductive element located on a surface of the rigid base die. At least one substantially planar antenna die having antennas located on a surface thereof is mechanically coupled to the base die at an oblique angle. The antenna die is of millimeter dimensions.

BRIEF DESCRIPTION OF THE DRAWINGS

Preferred embodiments of the subject matter described herein will now be explained with reference to the accompanying drawings of which.

DETAILED DESCRIPTION

Figure 1:
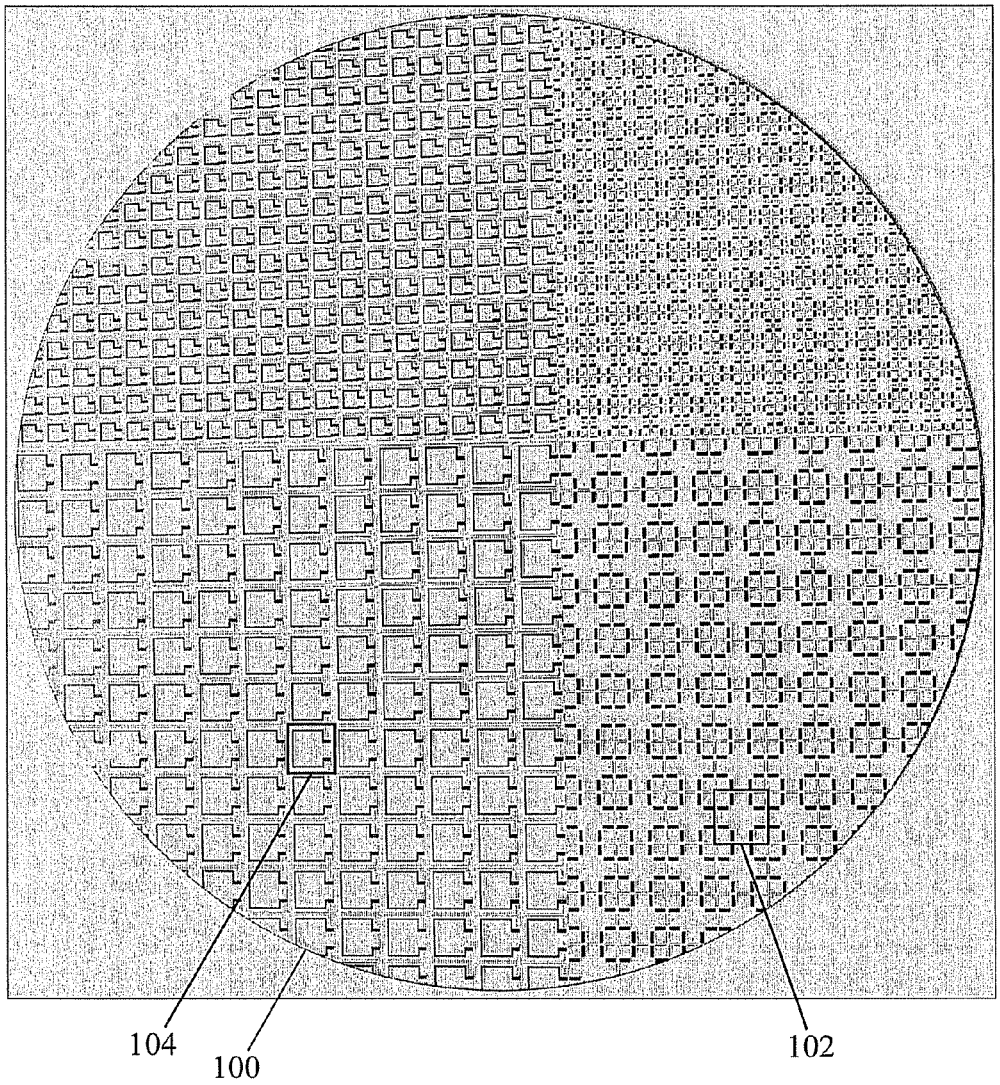
FIG. 1 is a top plan view of a substrate on which millimeter scale antenna and conductor structures can be patterned according to an embodiment of the subject matter described herein.

Millimeter scale three dimensional antenna structures and methods for fabricating such structures are disclosed. Millimeter scale antenna structures and associated conductors may be fabricated on a substrate. FIG. 1 illustrates an example of a Pyrex® Pyrex glass substrate with a plurality of millimeter scale antenna and other conductive structures patterned thereon. In particular, substrate 100 illustrated in FIG. 1 includes four quadrants, which are patterned with different sized antenna and other conductive structures. The upper left quadrant is patterned with loop antenna structures formed on 3 mm×3 mm dies. The upper right quadrant is patterned with pairs of conductors formed on 3 mm×3 mm dies. The lower left quadrant is patterned with loop antenna structures formed on 5 mm×5 mm dies. The lower right quadrant is patterned with conductors formed on 5 mm×5 mm dies. As an example, in the lower right quadrant, die 102 is referred to herein as a base die and it includes pairs of conductors located on opposite edges. Die 104 is an antenna die on which is formed a loop antenna. The conductors and the loop antenna structures may be deposited on substrate 100 using any suitable deposition technique for depositing metal on a substrate. It should also be noted that one or both sides of substrate 100 may be patterned with antennas and other conductive structures.

Figure 2:
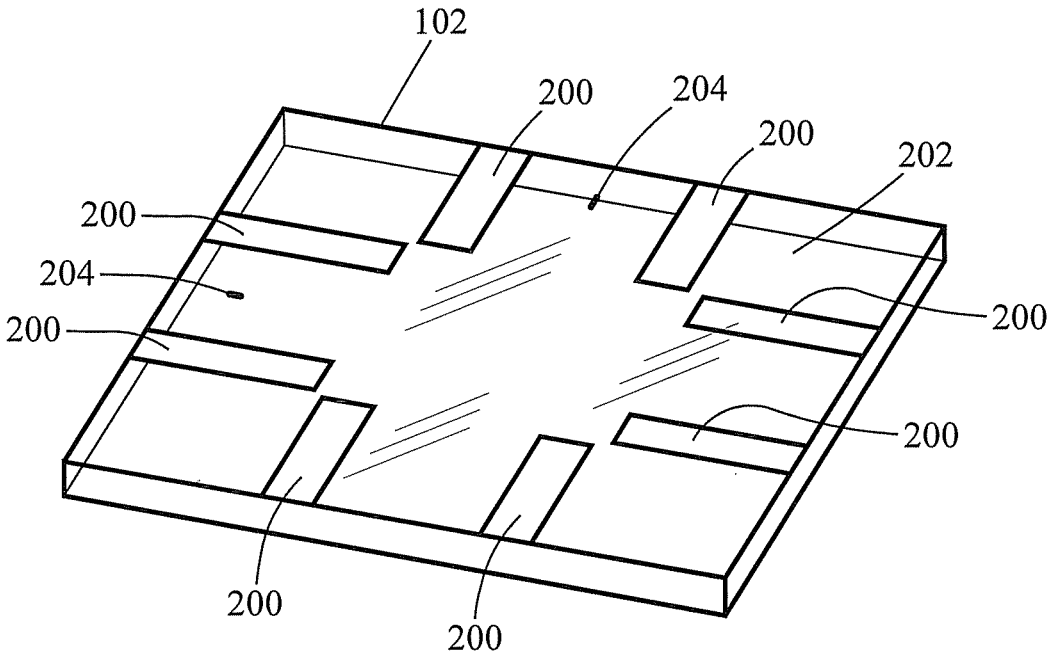
FIG. 2 is a perspective view of a base die according to an embodiment of the subject matter described herein.

After depositing the metal structures on substrate 100 illustrated in FIG. 1, the individual dies may be cut or chemically etched from the substrate. FIG. 2 illustrates an example of base die 102 after being cut or etched from substrate 100. Referring to FIG. 2, base die 102 includes a plurality of conductors 200 located on a surface 202 at opposite edges of surface 202. Base die 102 may also include alignment marks 204 to facilitate alignment with other dies in forming 3D antenna structures. In one implementation, base die 102 may be a substantially planar structure with a lateral edge length ranging from 3 mm to 5 mm. Larger or smaller base dies may be formed without departing from the scope of the subject matter described herein. For example, it is believed that the techniques described herein can be used to form base dies with edge lengths of 1 mm.

Figure 3:
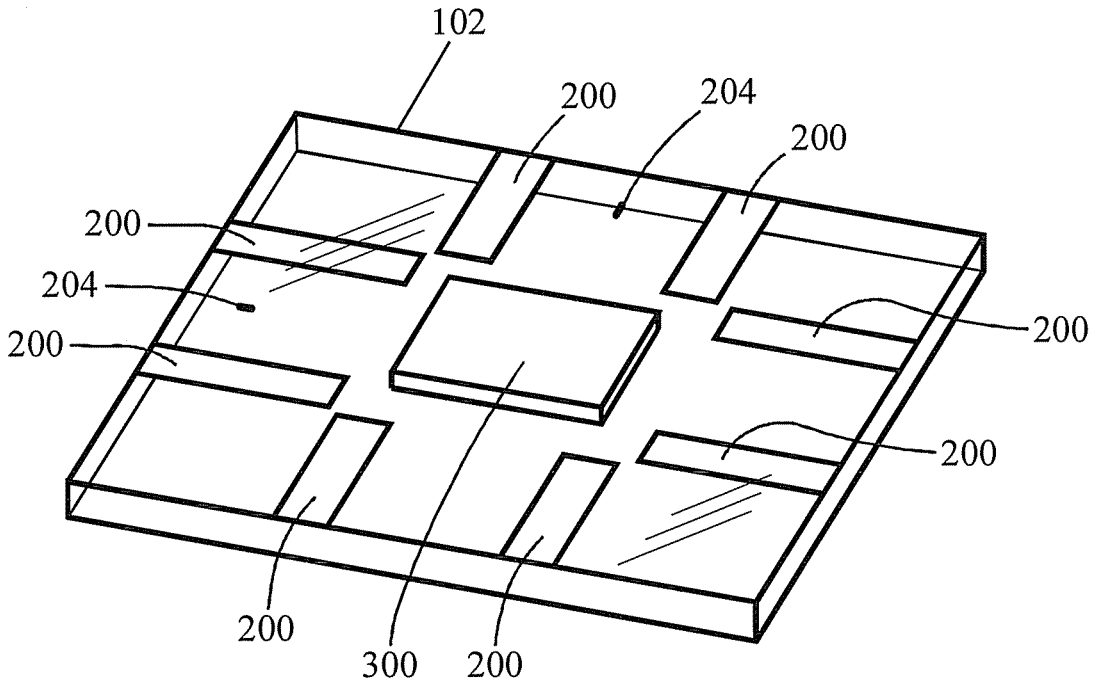
FIG. 3 is a perspective view of a base die with an integrated circuit located thereon according to an embodiment of the subject matter described herein.

An integrated circuit, such as a sensor, may be attached to base die 102. FIG. 3 illustrates an example of base die 102 within an integrated circuit 300 mounted thereon. In FIG. 3, integrated circuit 300 may be attached to base die 102 using an adhesive or any other suitable attachment method. Integrated circuit 300 may be connected to one or more of conductors 200 using wires or traces (not shown in FIG. 3).

Figure 4:
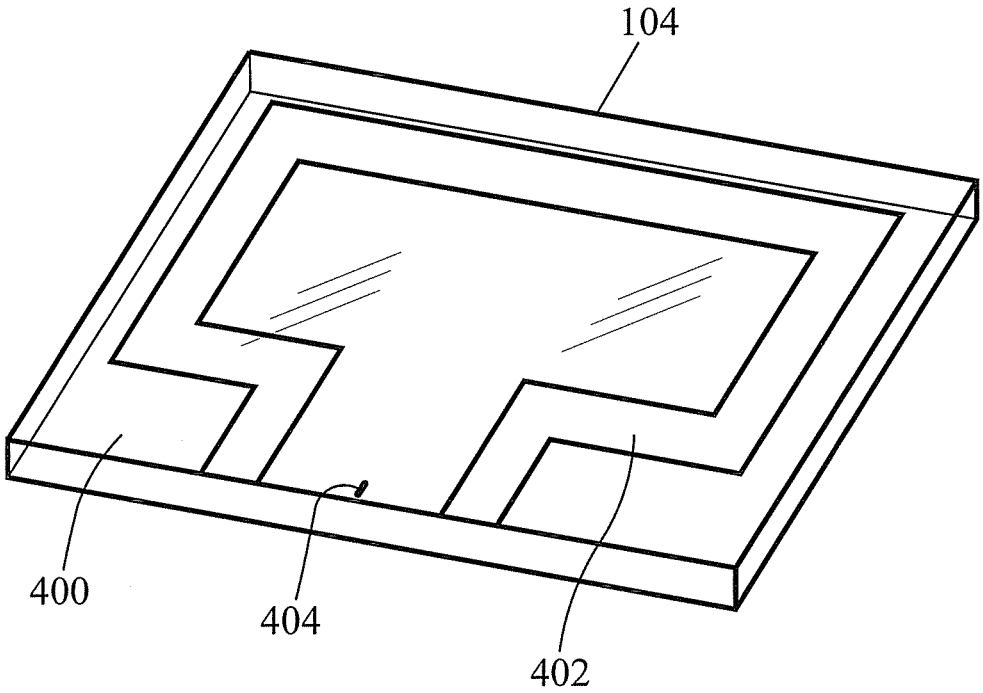
FIG. 4 is perspective view of an antenna die according to an embodiment of the subject matter described herein.
Figure 5:
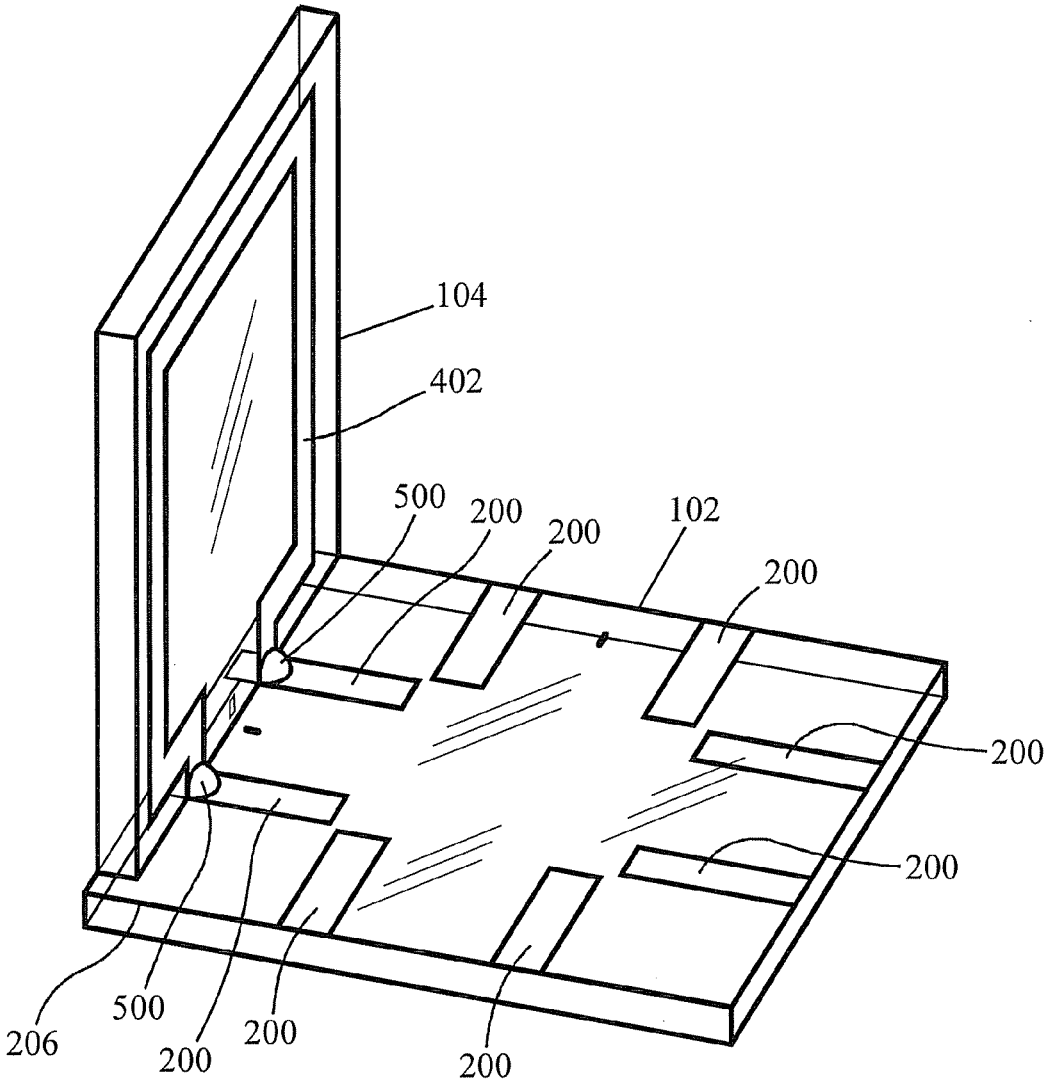
FIG. 5 is a perspective view of an antenna die mechanically coupled to a base die according to an embodiment of the subject matter described herein.

FIG. 4 illustrates an example of antenna die 104. In FIG. 4, antenna die 104 includes a loop antenna 402 patterned on surface 400 of antenna die 104. In an alternate example, antenna 402 may be a dipole or other suitable antenna structure. Antenna 402 may be offset from the center of surface 400 by an amount substantially equal to the thickness of die 104 to facilitate the formation of the 3D structures that include multiple antenna dies 104 mechanically coupled to a base die 102. Antenna die 104 may be a substantially planar structure in that is of millimeter dimensions. In one example, each side of antenna die 104 may have a length ranging from 3 mm to 5 mm. Antenna die 104 may also include an alignment mark 404 to facilitate alignment with alignment mark 204 on base die 102. Larger or smaller antenna dies may be formed without departing from the scope of the subject matter described herein. For example, it is believed that the techniques described herein can be used to form antenna dies with edge lengths of 1 mm Three dimensional antenna structures may be formed by mechanically coupling one or more antenna dies 104 to base die 102, such that antenna structure 402 extends at an oblique angle to base die 102. FIG. 5 illustrates one example of such a coupling. In FIG. 5, antenna die 104 is mechanically coupled to base die 102 through solder joints 500. To form solder joints 500, dies 102 and 104 may each be placed on surfaces that form an oblique angle to each other. Dies 102 and 104 may be aligned with each other such that the conductors of antenna 402 on the edge of die 104 align with any pair of conductors 200 on a given edge of base die 102. Because antenna structure 402 is offset from the center of antenna die 104 by an amount equal to the thickness of antenna die 104, sufficient room exists along edge 206 to allow another antenna die 104 to rest on die 102. After aligning dies 102 and 104 with each other, solder paste may then be applied to the intersection of pads 200 and antenna 402. Heat may be applied to reflow the solder, the solder may then be cooled, and solder joints 500 may be formed to provide both mechanical and electrical coupling between antenna 402 and pads 200.

Figure 6:
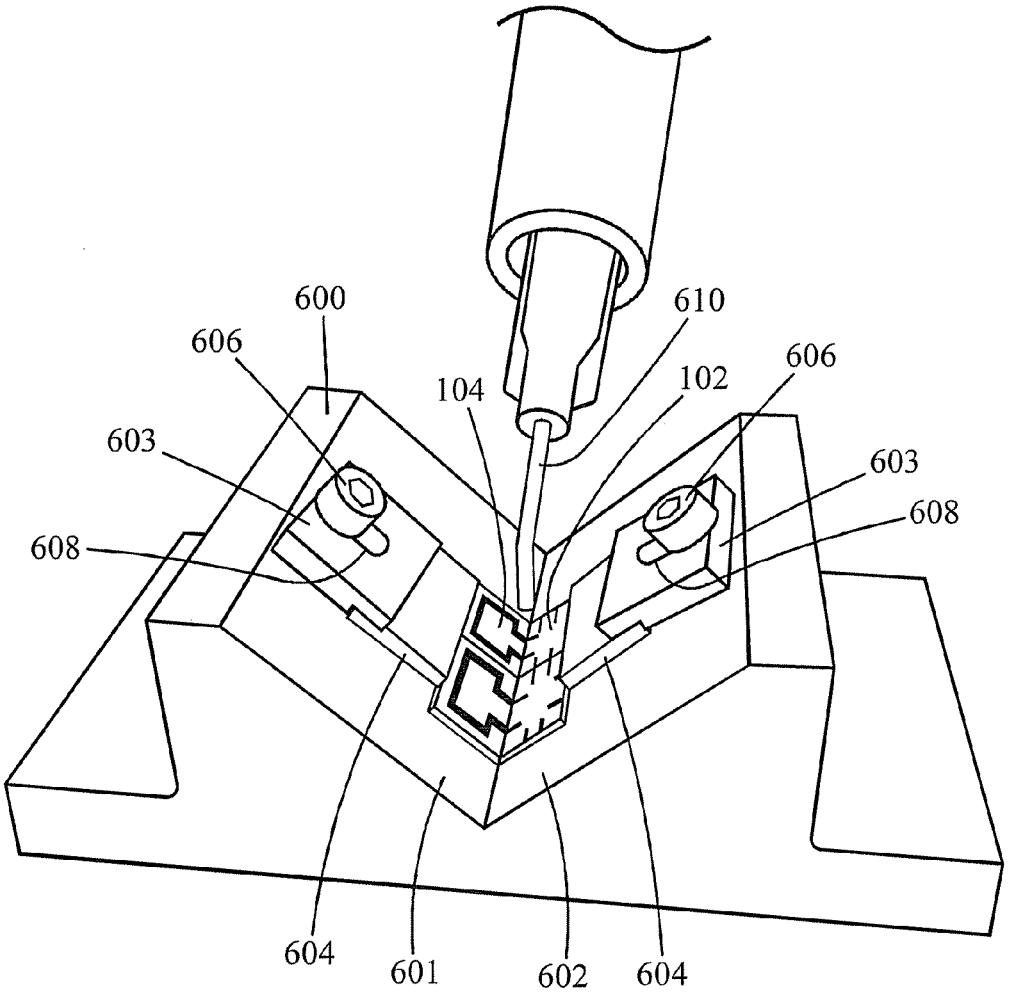
FIG. 6 is a perspective view of a jig for forming a three dimensional antenna structure according to an embodiment of the subject matter described herein.

FIG. 6 illustrates one example of a jig used to hold base die 102 and antenna die 104 in the position illustrated in FIG. 5 so that solder joints 500 can be formed. Referring to FIG. 6, a jig 600 includes surfaces 601 and 602 that form an oblique angle. Antenna die 104 and base die 102 are respectively placed on surfaces 601 and 602. Mechanical clamps 603 urge positioning members 604 against edges of dies 102 and 104. Adjustment screws 606 and channels 608 allow clamps 603 to move and apply lateral pressure to the edges of dies 102 and 104 to hold dies 102 and 104 in place. A solder paste applicator 610 applies beads of solder paste to the area where pads 200 meet antenna structures 402.

Figure 7A:
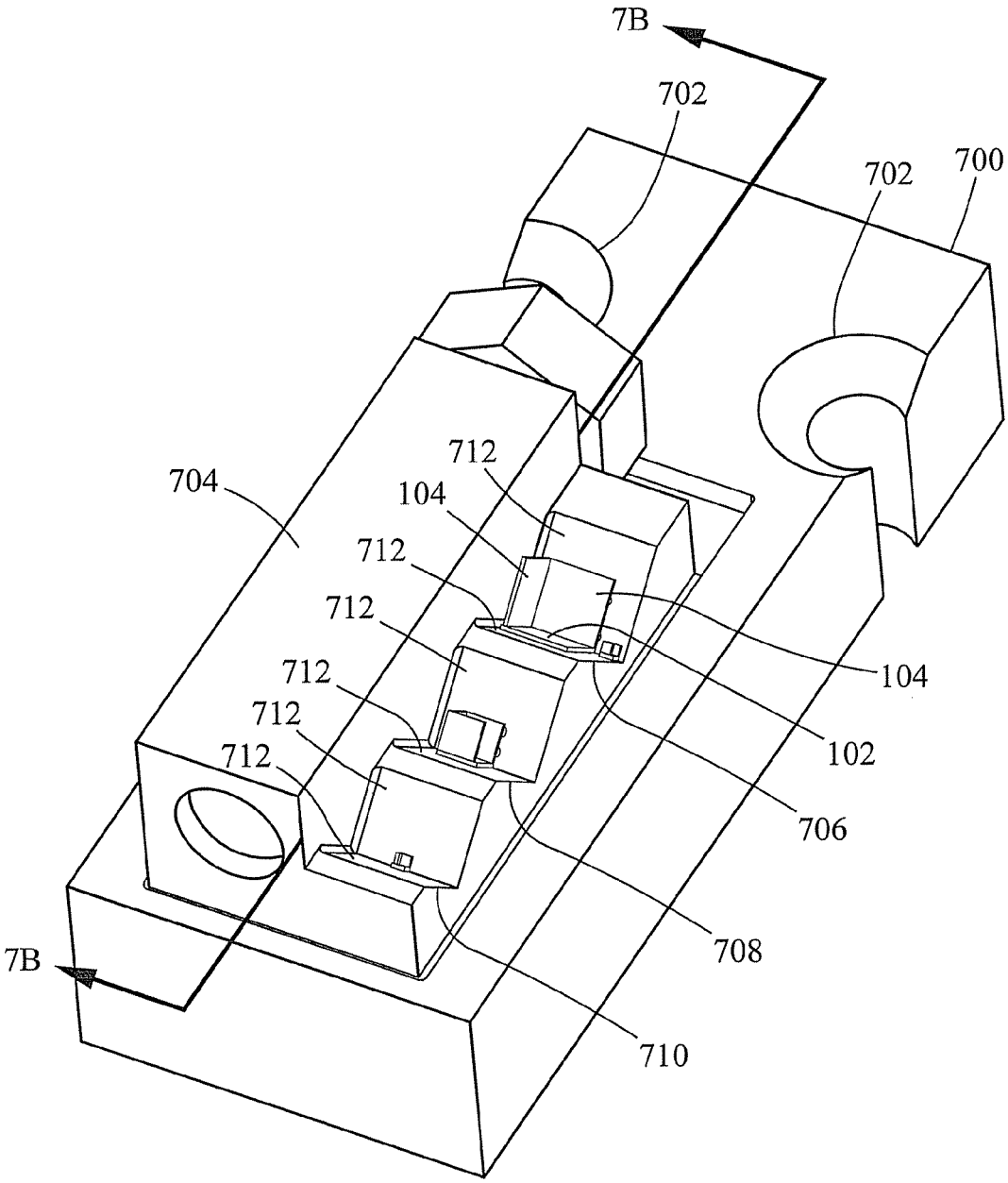
FIGS. 7A and 7B are examples of an alternate structure for a jig for forming three dimensional antenna structures according to an embodiment of the subject matter described herein.
Figure 7B:
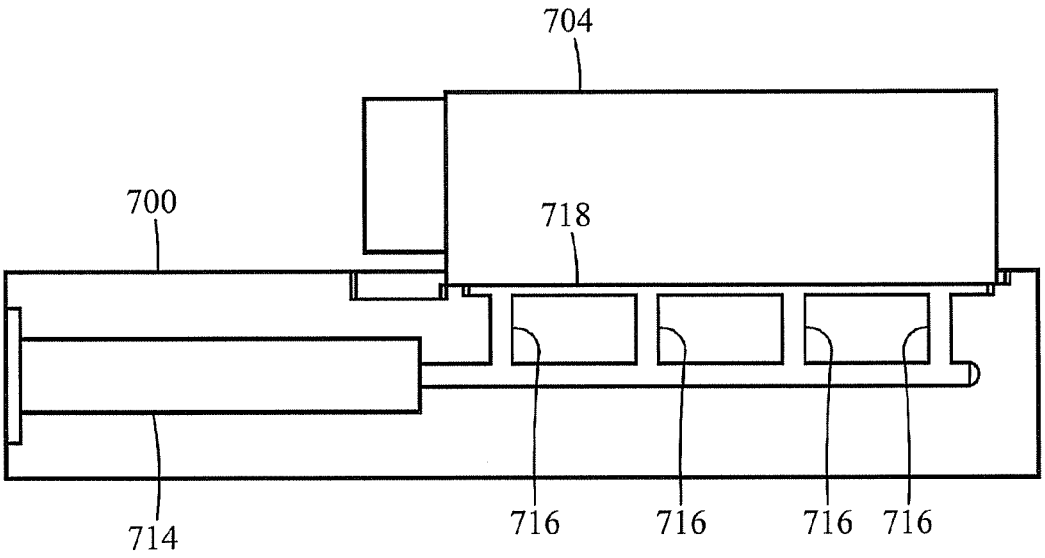

In the example illustrated in FIG. 6, dies 102 and 104 are held in place using clamps. In an alternate implementation, dies 102 and 104 may be held in place using a vacuum. FIGS. 7A and 7B illustrate an example of a jig that can be used to form 3D antenna structures where dies 102 and 104 are held in place using a vacuum. Referring to FIG. 7A, jig 700 includes counter sunk screw holes 702 for holding jig 700 to a surface. Jig 700 further includes valleys 706, 708, and 710, each having surfaces 712 that join at an oblique angle. Valleys 706, 708, and 710 may be made for different size 3D antenna structures. Each valley 706, 708, and 710 may include one or more vacuum ports (not shown in FIG. 7A) positioned under dies 102 and 104 to apply vacuum to dies 102 and 104 and urge dies 102 and 104 against surfaces 712. Jig 700 may also include a coupling 706 for coupling jig 700 to a thermocouple.

FIG. 7B is a sectional view of jig 700 illustrated in FIG. 7A. In FIG. 7B, a vacuum inlet 714 is configured to connect to a vacuum pump. Vacuum inlet 714 connects to vacuum channels 716 which underlie valleys 706, 708, and 710 illustrated in FIG. 7A. Vacuum channels 716 lead to a common upper vacuum chamber 718 that applies vacuum to vacuum ports in each valley illustrated in FIG. 7A.

Thus, in order to form the three dimensional antenna structures, dies 102 and 104 may be placed on surfaces 712 while a vacuum is being applied to dies 102 and 104. Solder paste may be applied to the junction between dies 102 and 104. Jig 700 may then be placed in a solder oven to reflow the solder paste. Once the solder reflows and cools, base die 102 may be rotated by an angle of 90 degrees, another antenna die 104 may be added, and the process may be repeated.

Figure 8A:
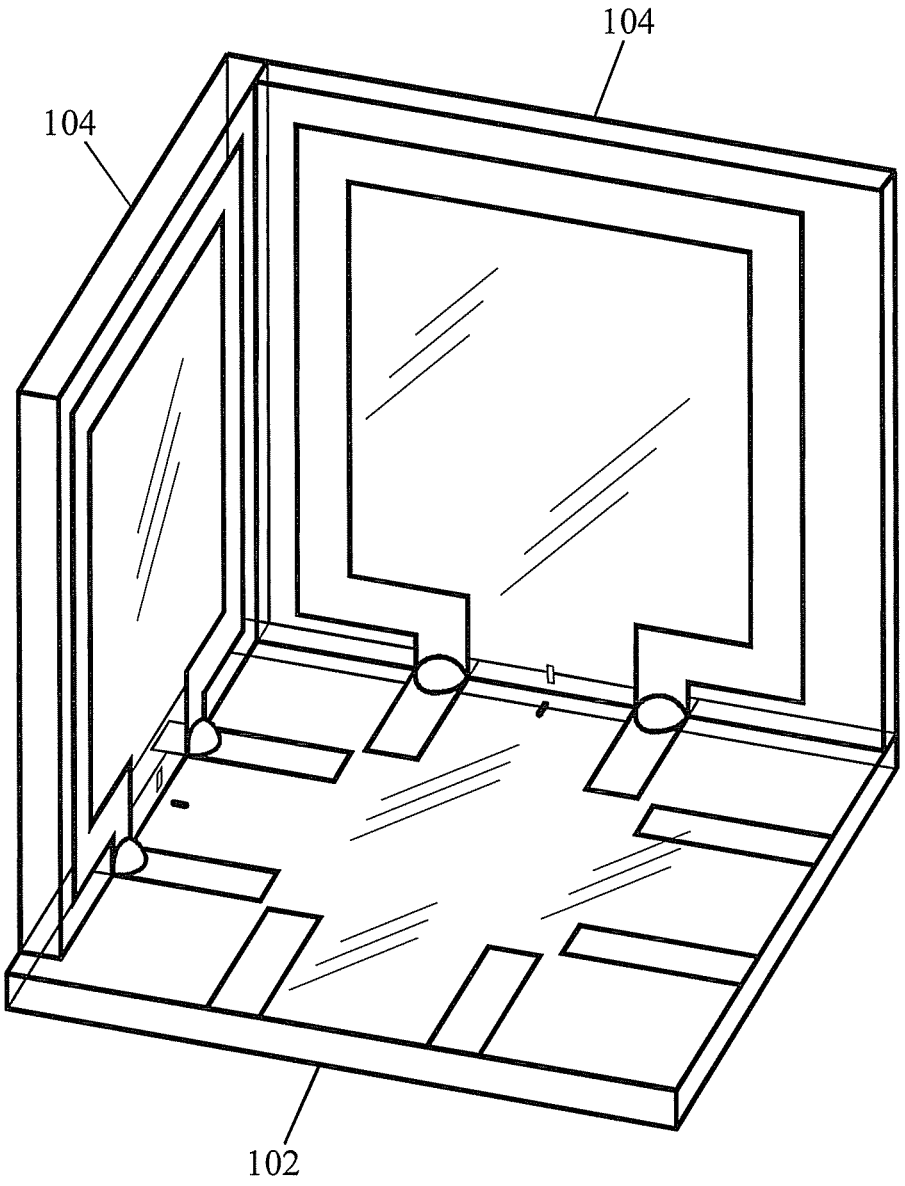
FIGS. 8A and 8B illustrate exemplary three dimensional antenna structures according to an embodiment of the subject matter described herein.
Figure 8B:
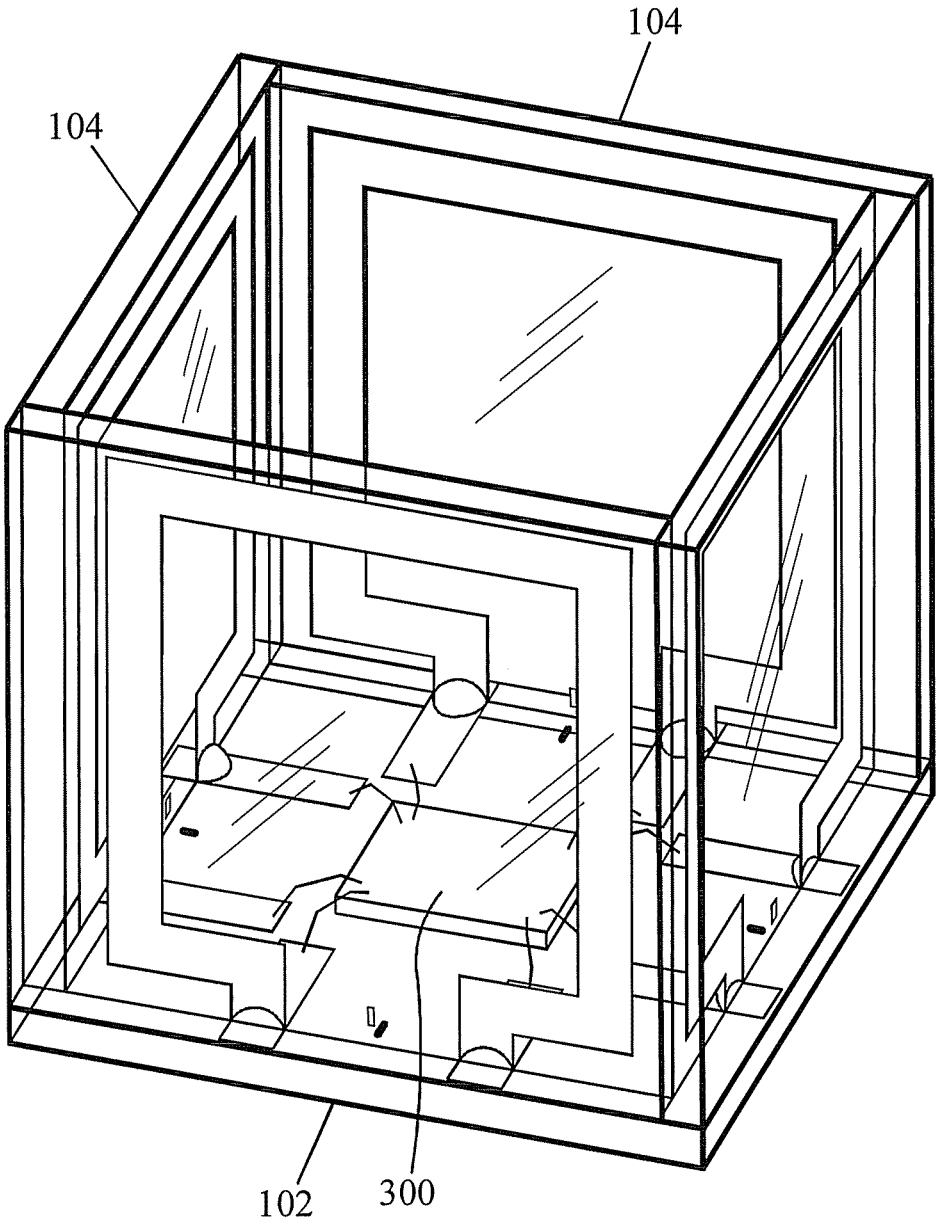

FIG. 8A illustrates an example where two antenna dies 104 are mechanically coupled to a single base die 102. FIG. 8B illustrates an example where four antenna dies 104 are joined to a single base die 102. It can be seen in FIG. 8B that antenna structures are located on four of the six faces of a cube. Other structures, such as parallelepiped or a pyramid can be formed without departing from the scope of the subject matter described herein. In FIG. 8B, integrated circuit 300 is electrically connected to conductors 200 using wires. Integrated circuit 300 may be placed on base die 102 and electrically connected to conductors 200 before antenna dies 104 are added or after antenna dies 104 are added. If the electrical connections between integrated circuit 300 and conductors 200 are formed before antenna dies 104 are soldered to their respective conductors 200, a higher temperature solder may be used to electrically connect integrated circuit 300 to conductors 200. Once the structure illustrated in FIG. 8B is formed, the interior region of a cube may be filled with an encapsulant, such as a plastic material, to provide structural support for dies 104 and to seal the components within the structure from the external environment. In a biological application, such as a biological sensor implant, the antennas on antenna dies 104 and the circuitry on base die 102 may be inward facing. In a non-biological application, the antennas and/or the electrical circuits may be outward facing, without departing from the scope of the subject matter described herein.

Figure 8C:
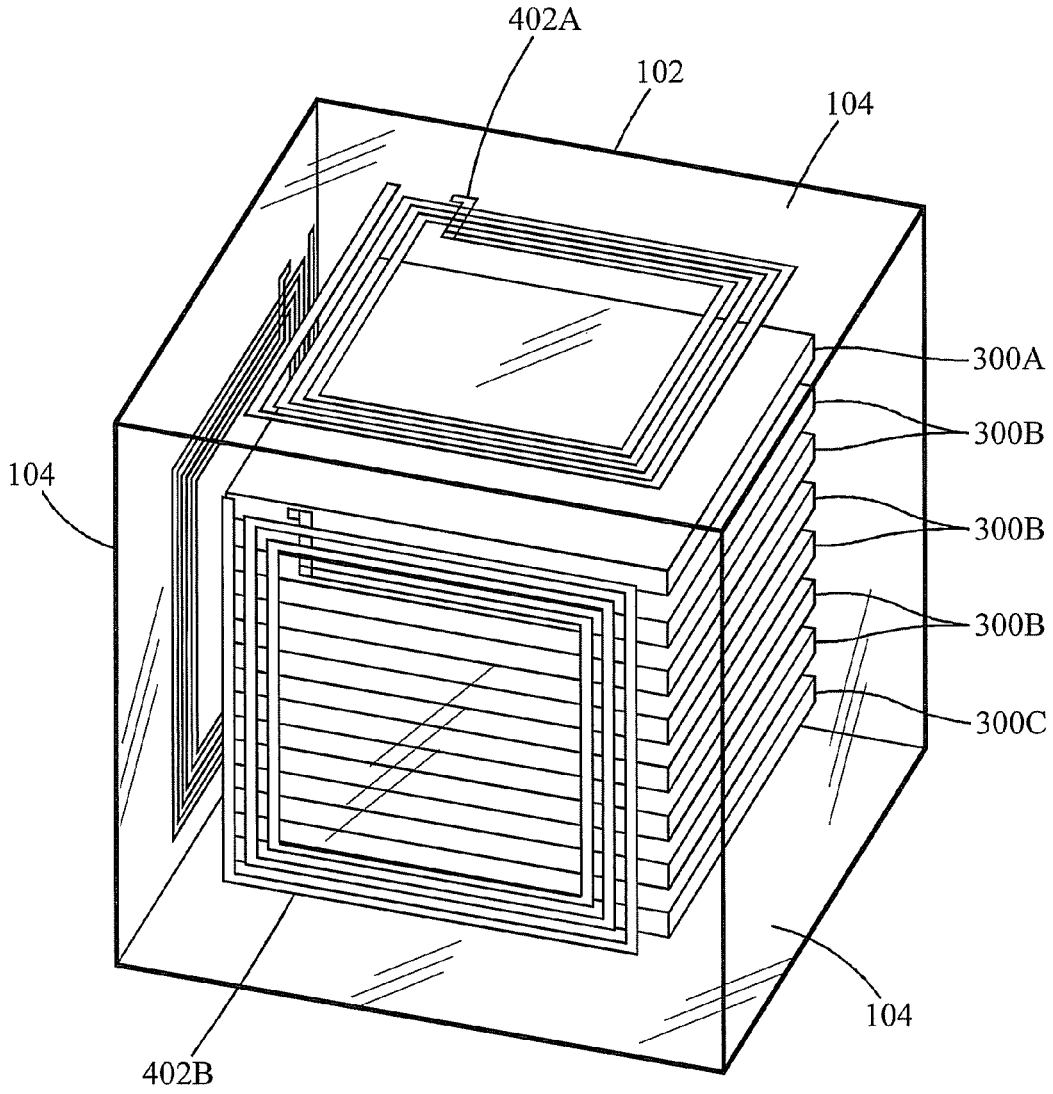
FIG. 8C is a perspective view illustrating a three dimensional antenna structure with interior power, processing, and sensing integrated circuits according to an embodiment of the subject matter described herein.

FIG. 8C illustrates another example where plural integrated circuits are located in the interior region formed by dies 102 and 104. In FIG. 8C, four antenna dies 104 are joined to a base die 102. A first integrated circuit 300A may be an RF power integrated circuit that harvests energy from antennas 402A and 402B in which current can be induced by an external magnetic field. It should be noted that in FIG. 4C, antennas 402A and 402B comprise spiral antennas made of substantially concentric loops or traces. Integrated circuits 300B may contain processing and memory components. Integrated circuit 300C may be a sensor, such as bio-sensor suitable for sensing parameters within a human body.

Figure 9A:
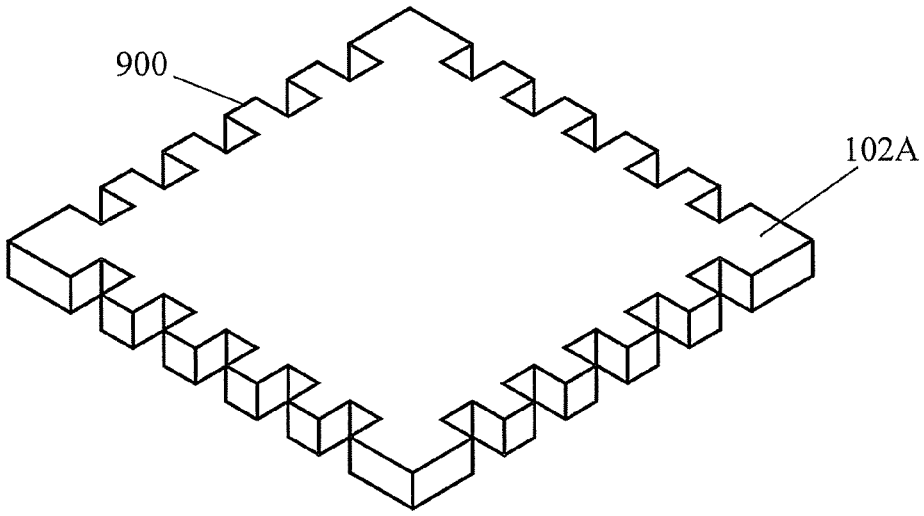
FIGS. 9A-9H are examples of dies that can be mechanically interlocked using interlocking fingers according to an embodiment of the subject matter described herein.
Figure 9B:
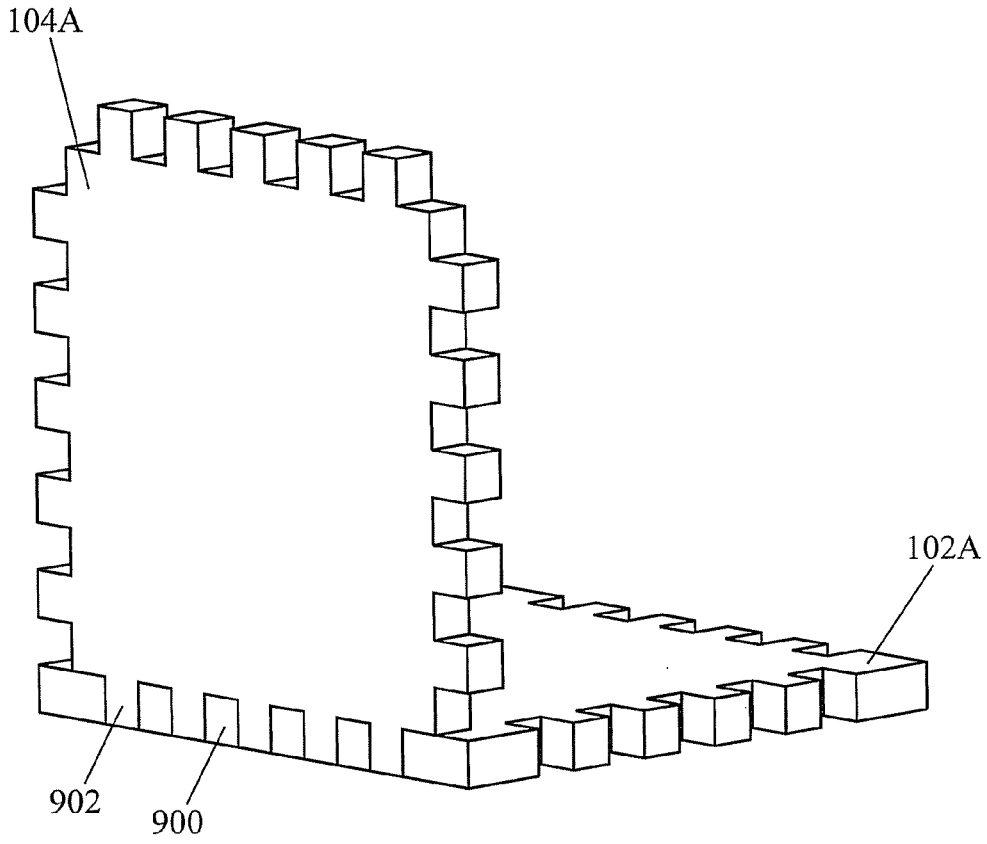
Figure 9C:
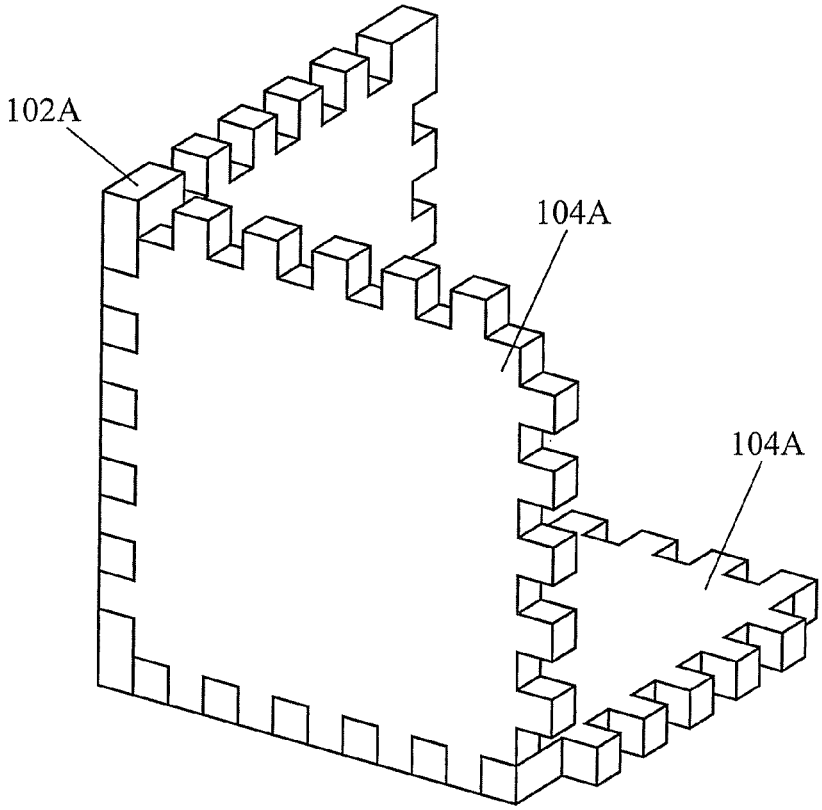
Figure 9D:
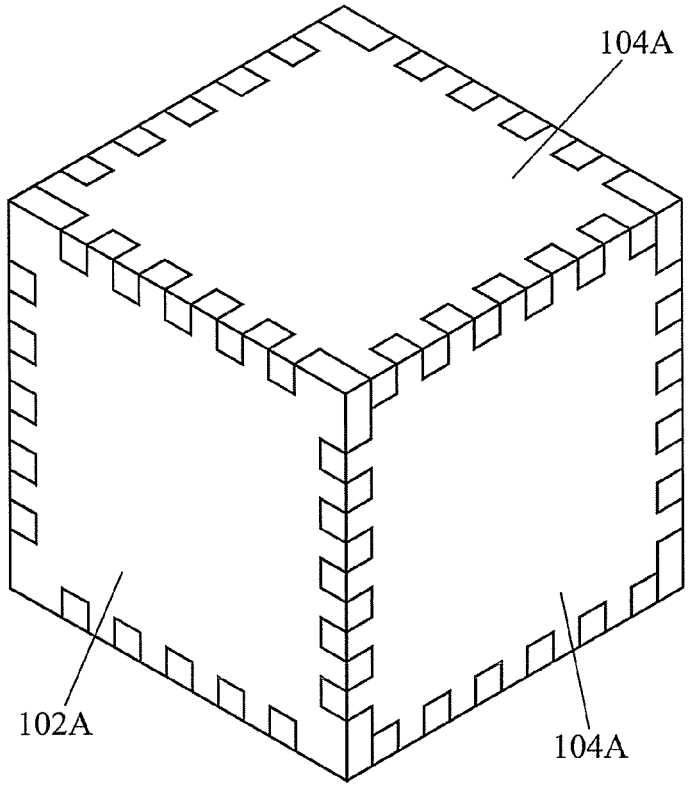

In the embodiments described above, base dies 102 are joined to antenna dies 104 using solder joints. In an alternate example, mechanical interlocks may be used to join base die 102 to antenna dies 104. FIGS. 9A-9E illustrate such an example. In FIGS. 9A-9H, each base die 102A includes mechanical interlocks located on the edges. Antenna die 104A also includes mechanical interlocks located on its edges. The mechanical interlocks may include laterally extending fingers or protrusions that interlock with corresponding fingers or protrusions extending laterally from the edge of another die. As illustrated in FIG. 9B, mechanical interlocks 900 joined with mechanical interlocks 902 to perform a mechanical connection between base die 102A and antenna die 104A. Interlocks 902 may be formed by chemically etching such structures when separating dies 102 and 104 from substrate 100. Multiple antenna dies 104A may be joined to a single base die, as illustrated in FIGS. 9C and 9D. Solder joints between conductive structures may also be used to further enhance the mechanical and electrical connections.

Alternatively, solder joints may be omitted and both electrical and mechanical connections can be made using interlocks 102. The solder joints and mechanically interlocking connections can be made by placing the dies into jigs, such as those illustrated in FIGS. 6, 7A, and 7B. In an alternate implementation, the interlocks and the solder joints can be formed without using jigs.

Figure 9E:
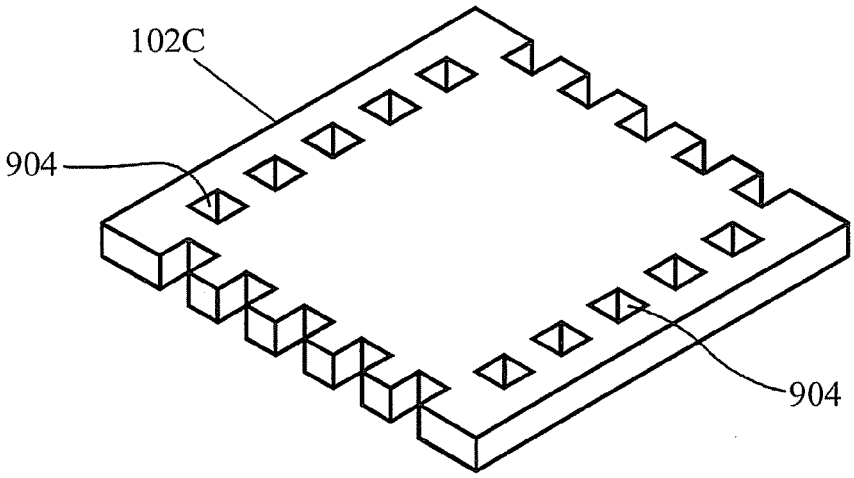
Figure 9F:
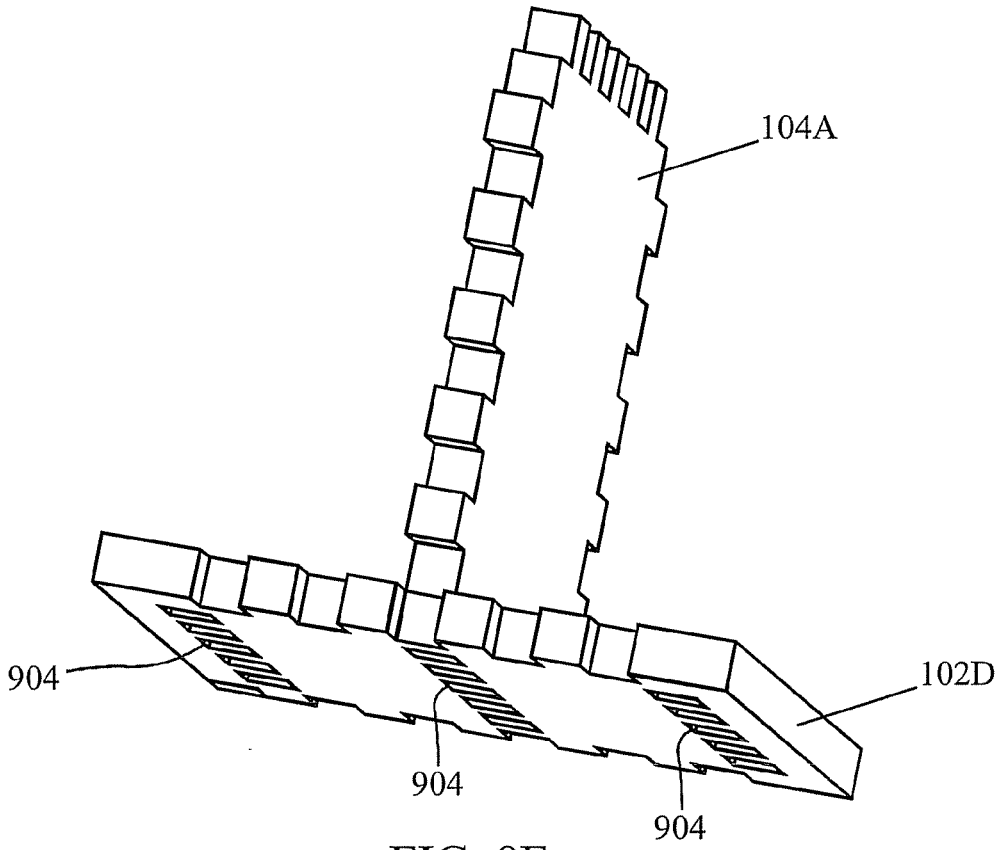
Figure 9G:
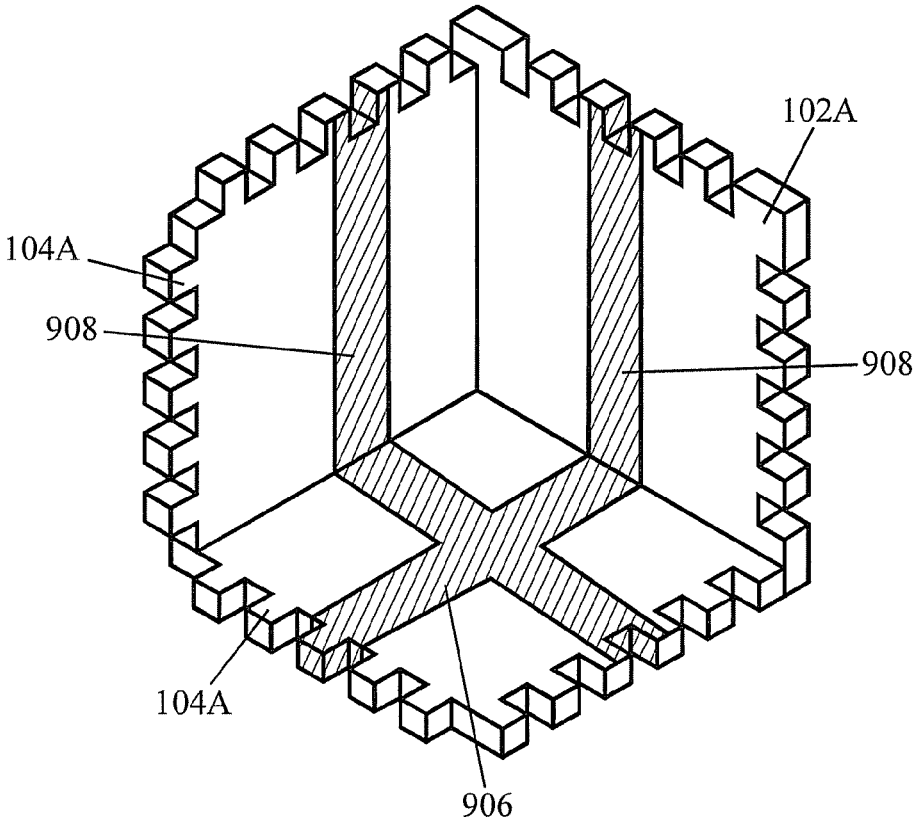
Figure 9H:
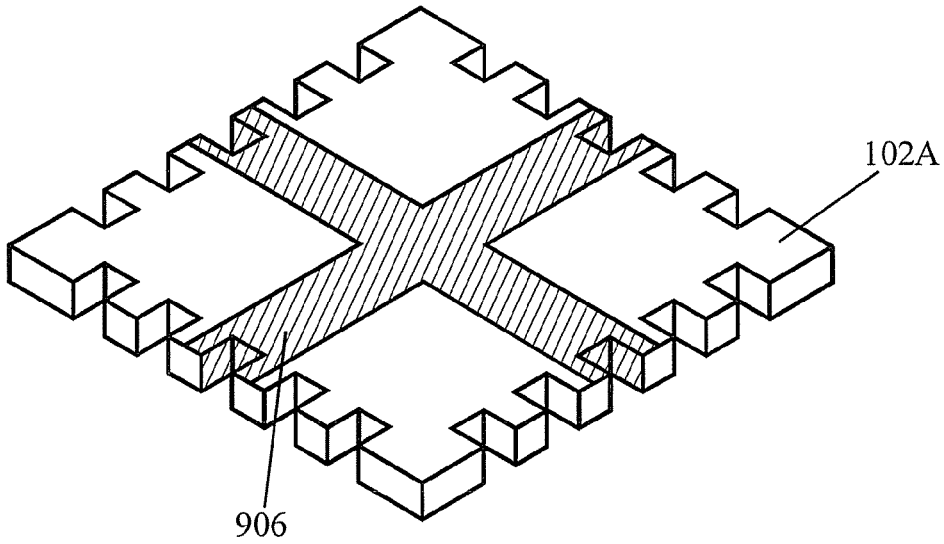

In FIG. 9E, base die 102C includes interior holes 904 that join with corresponding interlocking structures on antenna dies 104A. In FIG. 9F, base die 102D includes holes 904 in its center and at its edges. An antenna die 104A may interlock with any of the holes to form a three dimensional tee antenna structure, as illustrated in FIG. 9F. In FIG. 9G, antenna die 104A includes conductors 906 that form a cross pattern for connecting with dipole antennas 908 formed on antenna die 104A and base die 102A. FIG. 9H illustrates an example of base die 102A with antenna pattern 906.

Figure 10:
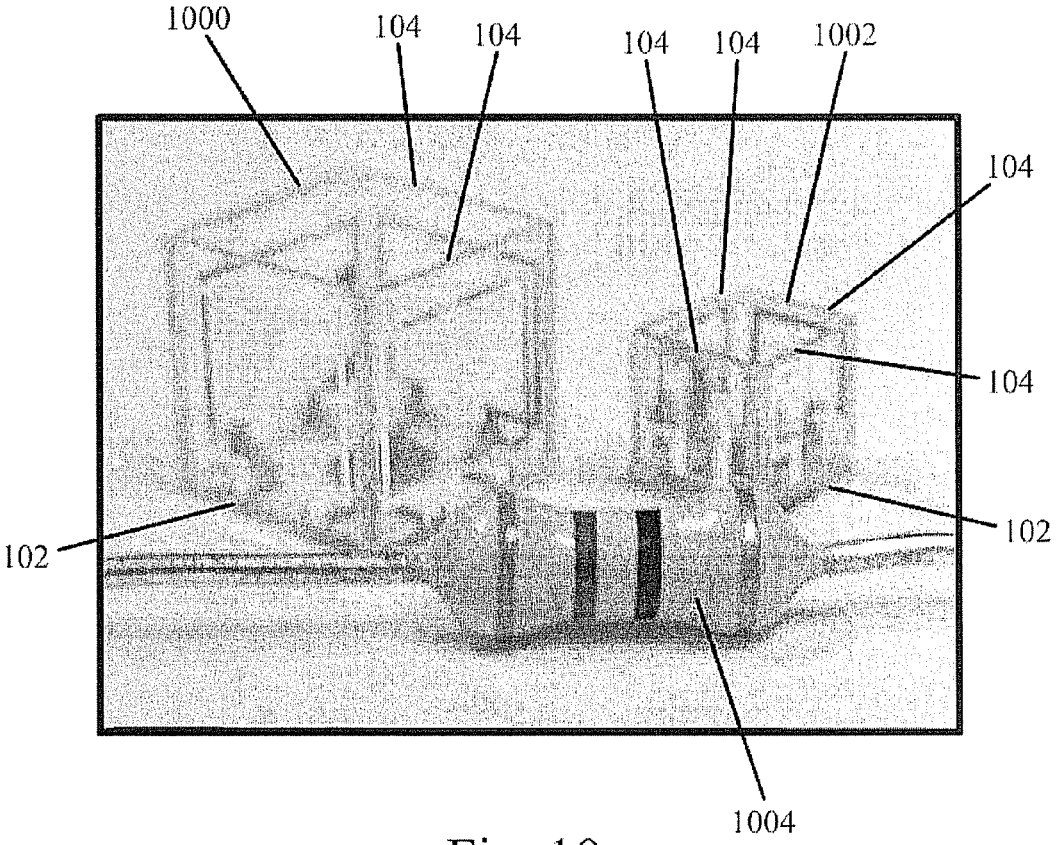
FIG. 10 is a photographic image of a 3 mm×3 mm×3 mm antenna structure, a 5 mm×5 mm×5 mm three dimensional antenna structure and a resistor (to show scale), according to an embodiment of the subject matter described herein.

FIG. 10 is an image of a three dimensional antenna structure 1000, three dimensional antenna structure 1002, and a resistor 1004 to illustrate scale. In the illustrated example, antenna structure 1000 includes antenna dies 104 and a base die 102 that are each 5 mm×5 mm in dimension. That is, the length of each edge of each die in structure 1000 is 5 mm. Similarly, antenna structure 1002 includes antenna dies 104 and base die 1002 that are each 3 mm×3 mm in dimension. That is, the length of each edge of the dies in structure 1002 is 3 mm.

In addition, the subject matter described herein is not limited to forming cubic antenna structures. The techniques described herein can be used to construct a single antenna orthogonally mounted with respect to its base, parallelepiped antennas, uniform prisms, pyramids, etc. Using interlocking fingers, as illustrated in FIGS. 9A-9H, different structures are possible.

In the examples described above, the substrate is Pyrex® glass. In alternate examples, the substrate can be non-Pyrex® glass, silicon, quartz, or any other material on which a conductive material can be formed.

The material that fills the interior region of antenna structures 1000 and 1002 can be any suitable material to provide mechanical rigidity. Such material is preferably non-conductive. An example of a material that may be used is a non-conductive epoxy or adhesive.

In addition to the applications described above, other applications for the subject matter described herein include antenna in package solutions, three dimensional antennas, three dimensional antenna arrays, mobile communications, 60 GHz applications, and near field energy harvesting.

In addition, although the terms "antenna die" and "base die" are used above, it is understood that an antenna die and a base die may be identical and either or both may include an antenna structure without departing from the scope of the subject matter described herein.

It will be understood that various details of the presently disclosed subject matter may be changed without departing from the scope of the presently disclosed subject matter. Furthermore, the foregoing description is for the purpose of illustration only, and not for the purpose of limitation.

What is claimed is:

1. A three-dimensional antenna structure, the three-dimensional antenna structure comprising:

a substantially planar rigid base die having a lateral edge length selected from a range of 3 mm to 5 mm and having at least one conductive element located on a surface of the rigid base die;

at least one substantially planar antenna die having an antenna located on a surface thereof and being mechanically coupled to the base die at an oblique angle, the at least one substantially planar antenna die having a lateral edge length selected from a range of 3 mm to 5 mm, wherein the base die includes four edges and wherein the at least one substantially planar antenna die comprises first, second, third and fourth antenna dies, each having an antenna and extending from one of the edges of the base die at the oblique angle to form faces of a parallelepiped, wherein each of the antennas comprises a loop antenna having first and second ends that are electrically and mechanically coupled to conductors on the surface of base die through solder joints and wherein each of the antennas is offset from a center of its respective antenna die; and a bio-sensor mounted on the base die for sensing parameters within a human body, the bio-sensor being coupled to the antennas.

2. The antenna structure of claim 1 wherein the base die comprises a square and wherein the parallelepiped comprises a cube.

3. The antenna structure of claim 1 wherein the base die and the at least one substantially planar antenna die comprise a glass material.

4. The antenna structure of claim 1 comprising a circuit element located on the base die and electrically coupled to the conductive element on the base die.

5. The antenna structure of claim 1 wherein the oblique angle comprises 90 degrees.

6. The antenna structure of claim 1 comprising mechanical interlock structures formed in or on the base and antenna dies for mechanically coupling the base and antenna second dies to each other.

7. The antenna structure of claim 6 wherein the mechanical interlock structures electrically couple the antenna structure to at least one of the conductive elements on the base die.

8. The antenna structure of claim 1 comprising mechanical interlock structures formed in or on the base and antenna dies for mechanically coupling the base and antenna dies to each other and further comprising solder joints for mechanically and electrically coupling the antenna to at least one of the conductive elements on the base die.

9. The antenna structure of claim 1 wherein the at least one conductive element on the base die comprises an antenna.

10. The antenna structure of claim 1 wherein the at least one conductive element on the base die comprises conductive pads located on opposite edges of the base die.

11. The antenna structure of claim 10 comprising a circuit element located on the base die and connected to the conductive pads.

12. The antenna structure of claim 1 wherein an amount of the offset is equal to a thickness of one of the antenna dies.

13. The antenna structure of claim 1 wherein each antenna die extends across the surface of the base die along an edge of the base die and terminates prior to reaching another edge of the base die.

14. The antenna structure of claim 1 wherein the antenna dies and the base die form an interior region and the interior region is filled with an encapsulant.

* * * * *